US005269479A

United States Patent [19]

Budin et al.

[11] Patent Number: 5,269,479

[45] Date of Patent: Dec. 14, 1993

[54] REEL-TRANSFER APPARATUS AND METHOD

[75] Inventors: Marc Budin, Marin; Maurice Berger, Cortaillod; Michael Lauenstein, Cormondrèche, all of Switzerland

[73] Assignee: Fabriques de Tabac Reunies, S.A., Neuchatel, Switzerland

[21] Appl. No.: 868,137

[22] Filed: Apr. 14, 1992

[30] Foreign Application Priority Data

Apr. 16, 1991 [CH] Switzerland ..... 1130/91

[51] Int. Cl.[5] ..... B65H 19/12

[52] U.S. Cl. ..... 242/58.6

[58] Field of Search ..... 242/58.6, 79, 58, 58.1, 242/58.2, 58.3, 58.4, 68.3

[56] References Cited

U.S. PATENT DOCUMENTS

| | | | |
|---|---|---|---|
| 4,441,662 | 4/1984 | Seragnoli | 242/58 |
| 4,589,811 | 5/1986 | Riccardo et al. | 242/58.6 X |
| 4,840,321 | 6/1989 | Focke et al. | 242/68.3 X |
| 4,995,406 | 2/1991 | da Silva | 131/105 |
| 5,018,535 | 5/1991 | da Silva et al. | 131/60 |
| 5,031,381 | 7/1991 | Focke | 242/58.6 X |
| 5,205,505 | 4/1993 | Focke et al. | 242/58.6 |

FOREIGN PATENT DOCUMENTS

| | | |
|---|---|---|
| 0261508 | 3/1988 | European Pat. Off. . |
| 1338396 | 8/1963 | France . |
| 2066789 | 7/1981 | United Kingdom . |

*Primary Examiner*—John M. Jillions
*Attorney, Agent, or Firm*—Jeffrey H. Ingerman

[57] ABSTRACT

A reel hub (5), an inside rod (70) of which can slide axially when acted upon by a seizing rod (82), forms part of the transfer apparatus (3). By bringing the transfer apparatus opposite the hub of a rotating reel (21, 20), and by withdrawing the inside rod from the hub, the hub is disengaged from a machine (1), the reel continuing to rotate with its hub fixed to the transfer apparatus. This apparatus can then be moved in directions situated in the plane of rotation of the reel and brought opposite another shaft of the machine in order to reattach the hub there by reversing the foregoing procedure. A rotating reel, especially one paying out a strip of cigarette paper, can thus be moved without subjecting the strip of paper to any torsion. Other operations relating to the automatic operation of the machine are also possible with the aid of the transfer apparatus.

22 Claims, 10 Drawing Sheets

Figure 1:
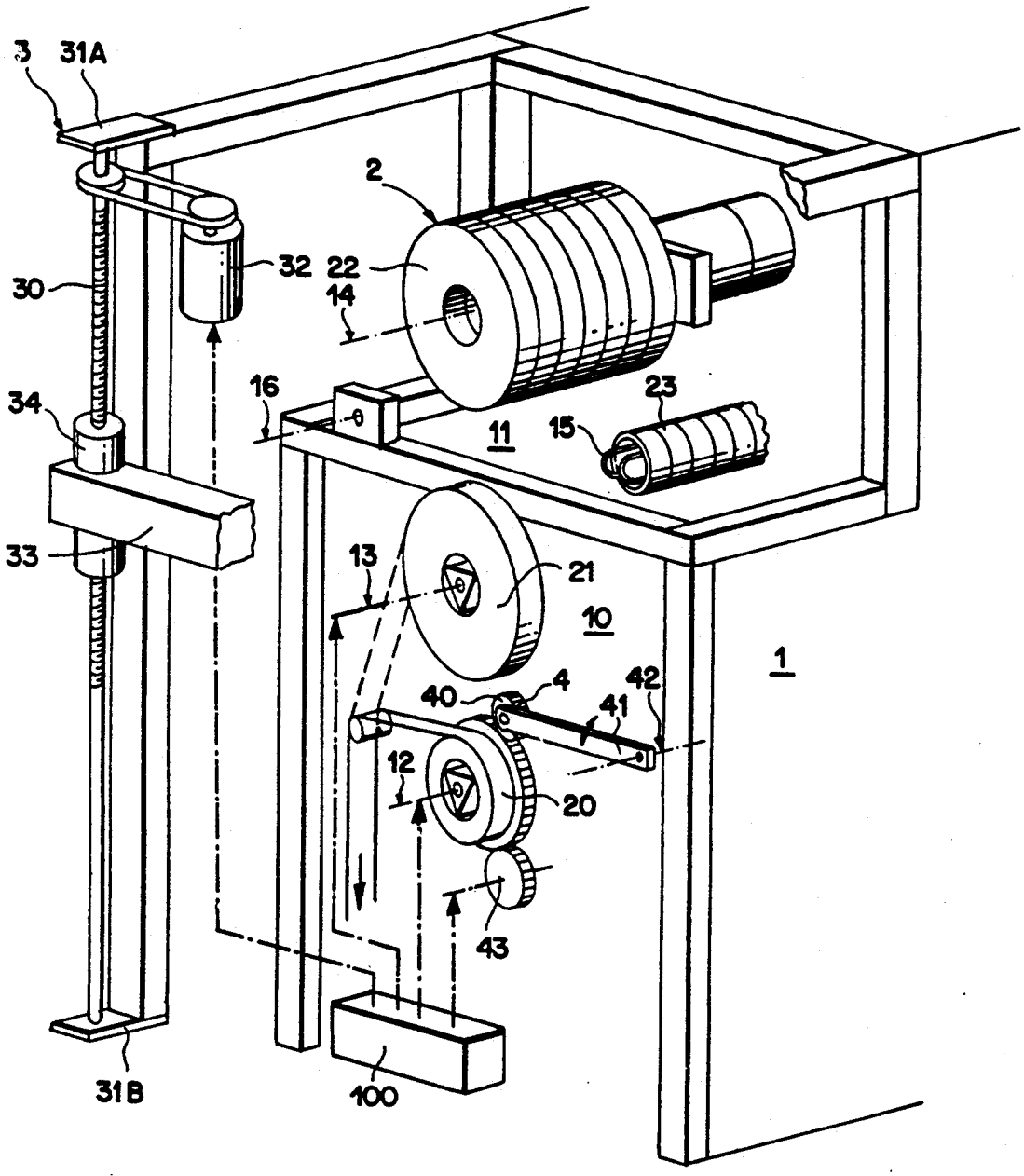

FIG. 6A
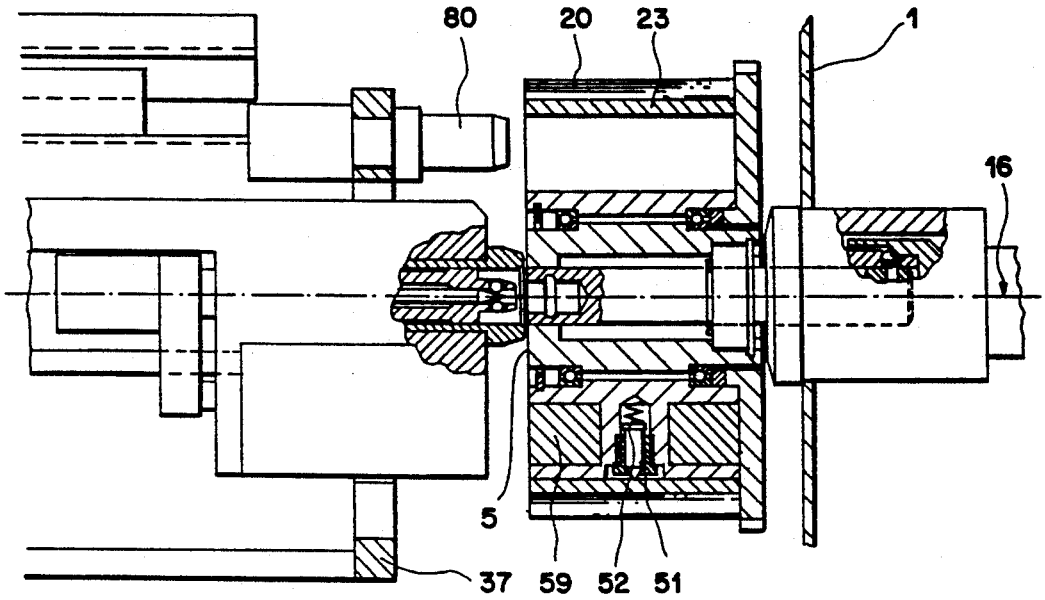
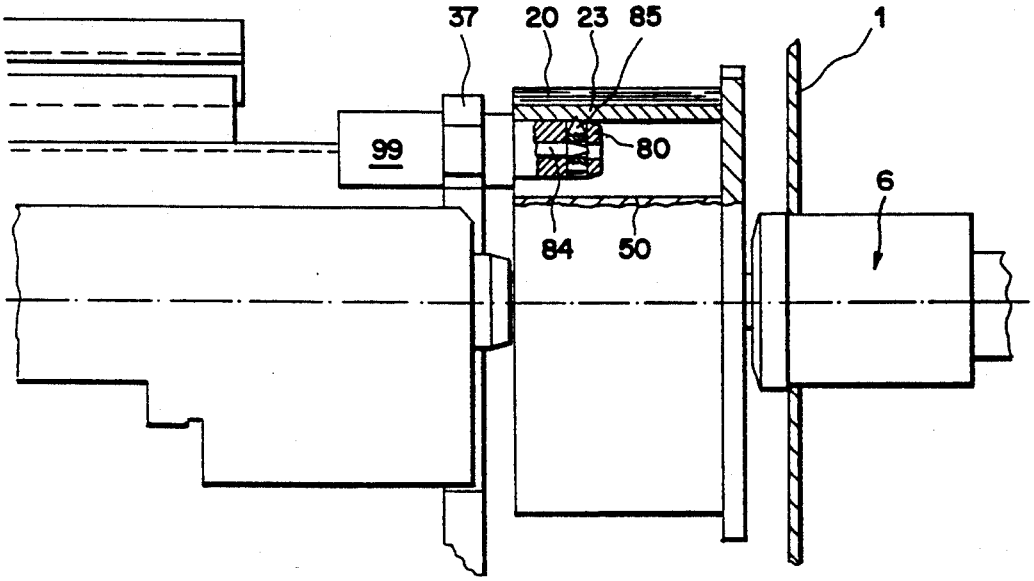
FIG. 6B

REEL-TRANSFER APPARATUS AND METHOD

This invention relates to production methods and equipment, and more particularly to apparatus and a method of transferring a bobbin or reel being paid out, between a first pay-out shaft and a second pay-out shaft of a machine, while the reel remains in a constant plane of rotation during the transfer. The invention further relates to a bobbin or reel hub for carrying out the method.

In numerous production machines, one of the components of the product produced by the machine takes the form of an element of a certain length wound on a bobbin; owing to the productivity required of the machine, it is usually not possible to stop it when a bobbin is empty in order to replace it. Numerous devices have been developed for joining the inner end of a component disposed on an almost empty bobbin to the outer end of the component disposed on a full bobbin so that this component may be paid out continuously, without its being necessary to stop the machine. An operation of this kind generally requires the bobbins to be shifted. When the component to be paid out is a strip, easily torn and/or deformed, the operation of shifting the bobbins becomes complicated since the strip cannot be skewed and must always be paid out in a single plane.

This problem is particularly acute in paper-feeding machines such as are found in the cigarette industry. The strips of paper used in such machines, whether the web of paper directly surrounding the tobacco of the cigarette or the one encircling the filter, are extremely thin and fragile and are paid out at very high speeds. Such a strip of paper is usually wound in a single length on a flat bobbin, i.e., a reel. As it is not possible to stop the machine for changing the reel of paper when it is empty, apparatus has been developed for joining the end of a strip of paper on one reel to the end of another strip of paper on another reel. Such apparatus is described particularly in U S. Pat. Nos. 5,018,535 and 4,995,406 and in copending, commonly-assigned U.S. paten application Ser. No. 07/743,121, filed Aug. 9, 1991, now U.S. Pat. No. 5,169,082.

It is therefore an object of this invention to provide an improved method and means for transferring a reel of paper being paid out from one axis of rotation of a machine to another axis of rotation of the machine without the risk of tearing or twisting the strip of paper.

It is a further object of the invention to provide a method and means of carrying out the foregoing operation without having to stop the machine.

Another object is to provide such a method and means of transfer which can be carried out completely automatically.

Still another object is to provide transfer apparatus capable of being added to a conventional machine for paying out cigarette paper and to cause this apparatus to carry out automatically all the operations of transferring reels and/or the cores of reels, as well as of stocking, necessary for the operation of the machine.

An additional object of the invention is to provide a reel hub for use in carrying out the inventive method.

To this end, the transfer apparatus according to the present invention comprises, on the one hand:

a first means of displacement in a first direction, which may consist of a horizontal beam subjected to a translatory motion via at least one worm and a nut device, a second means of displacement in a second direction perpendicular to the first direction, which may consist of an intermediate support fixed to the horizontal beam via a motorized slide, a third means of displacement in a third direction perpendicular to the first and second directions, which may consist of a movable support fixed to the intermediate support via a motorized slide, a retractable socket which can assume two positions in a direction parallel to the third direction, relative to the movable support, a seizing rod which can assume two positions in a direction parallel to the third direction, relative to the retractable socket;

on the other hand:

a plurality of hub-support devices disposed on a plurality of shafts of the machine, as well as:

a reel-hub device capable of supporting a rotating reel and comprising a part capable of sliding axially in the third direction.

In the transfer method according to the present invention, of the type initially mentioned, the transfer is carried out by means of the transfer apparatus, moving in space and capable of seizing a hub of the rotating reel, of detaching the hub from the first pay-out shaft, of transferring the hub as well as the rotating reel to the second pay-out shaft, and of fixing the hub to this second pay-out shaft.

The reel hub according to the present invention comprises a portion including empty spaces, mounted on a central socket via ball bearings, this central socket including a bore in which a rod can move longitudinally, a first end of the rod including a groove along a perimeter, intended to receive the bearing balls disposed under a frustoconical surface portion of a bell-shaped part when the first end of the rod is inserted into the longitudinal bore of the hub support, the other end of the rod including a coaxial blind bore including a groove along a perimeter, intended to receive the balls disposed near the end of the seizing rod when this seizing rod is inserted in the blind bore.

Figure 2A:
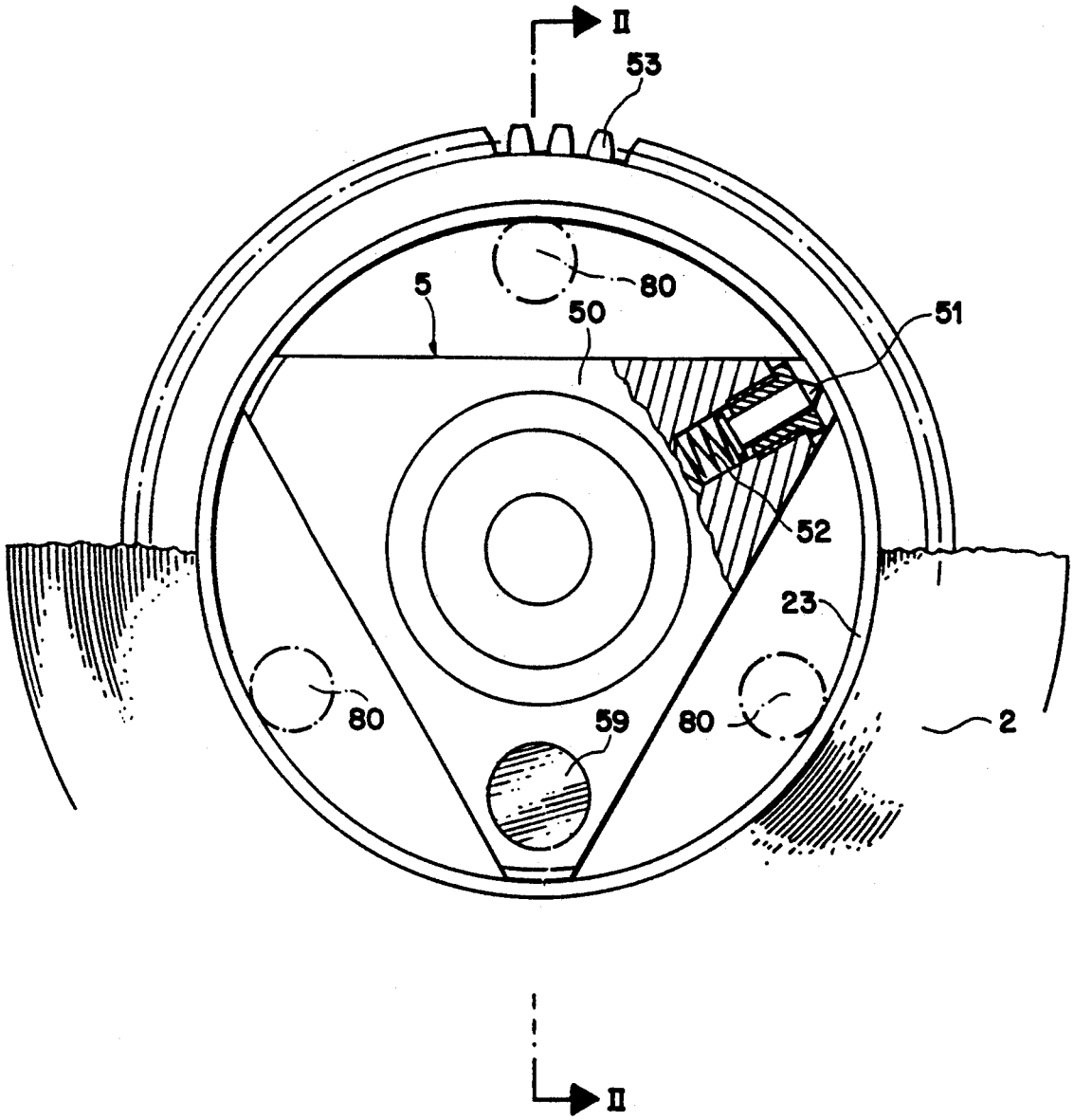
Figure 2B:
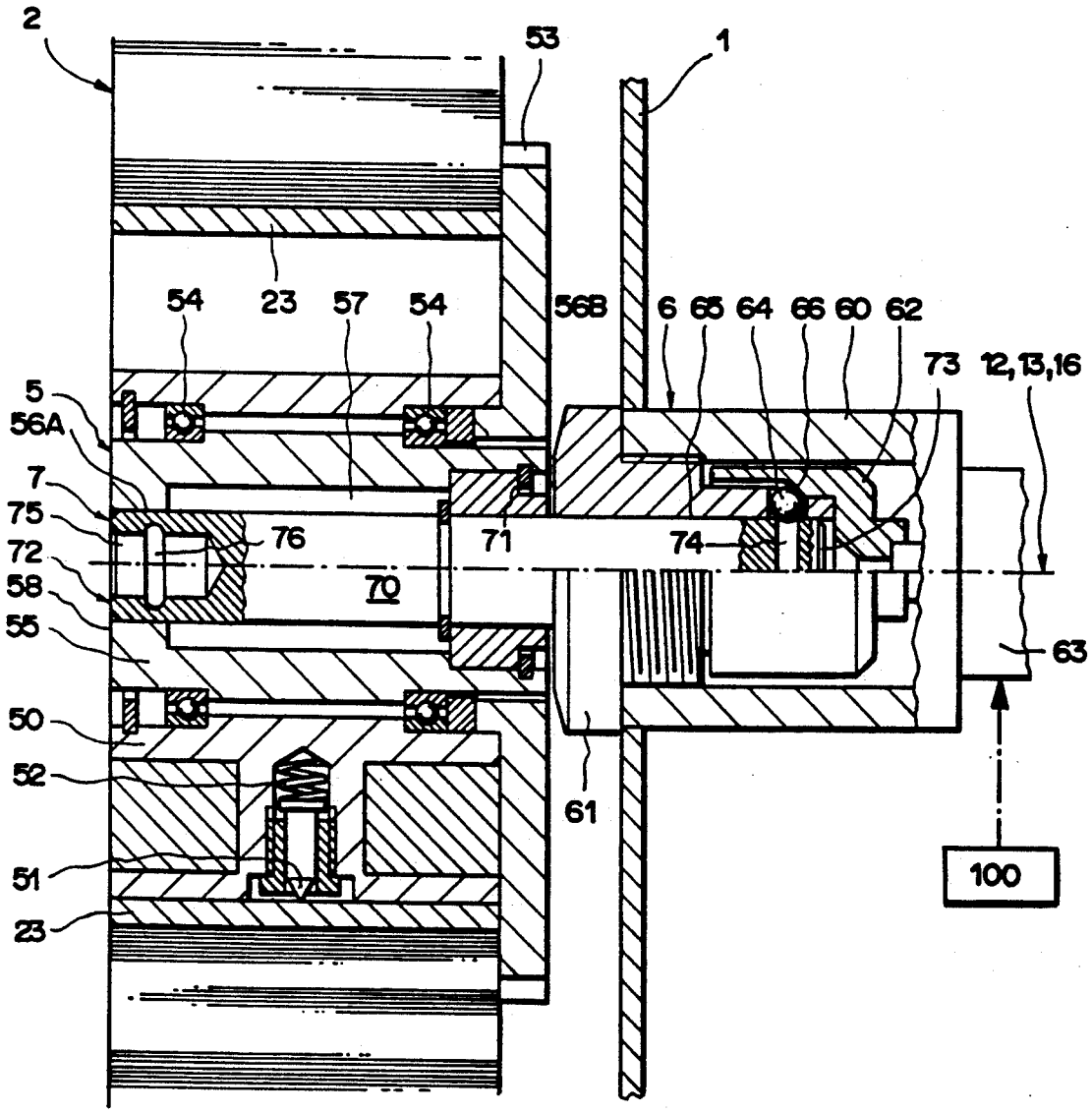
Figure 3:
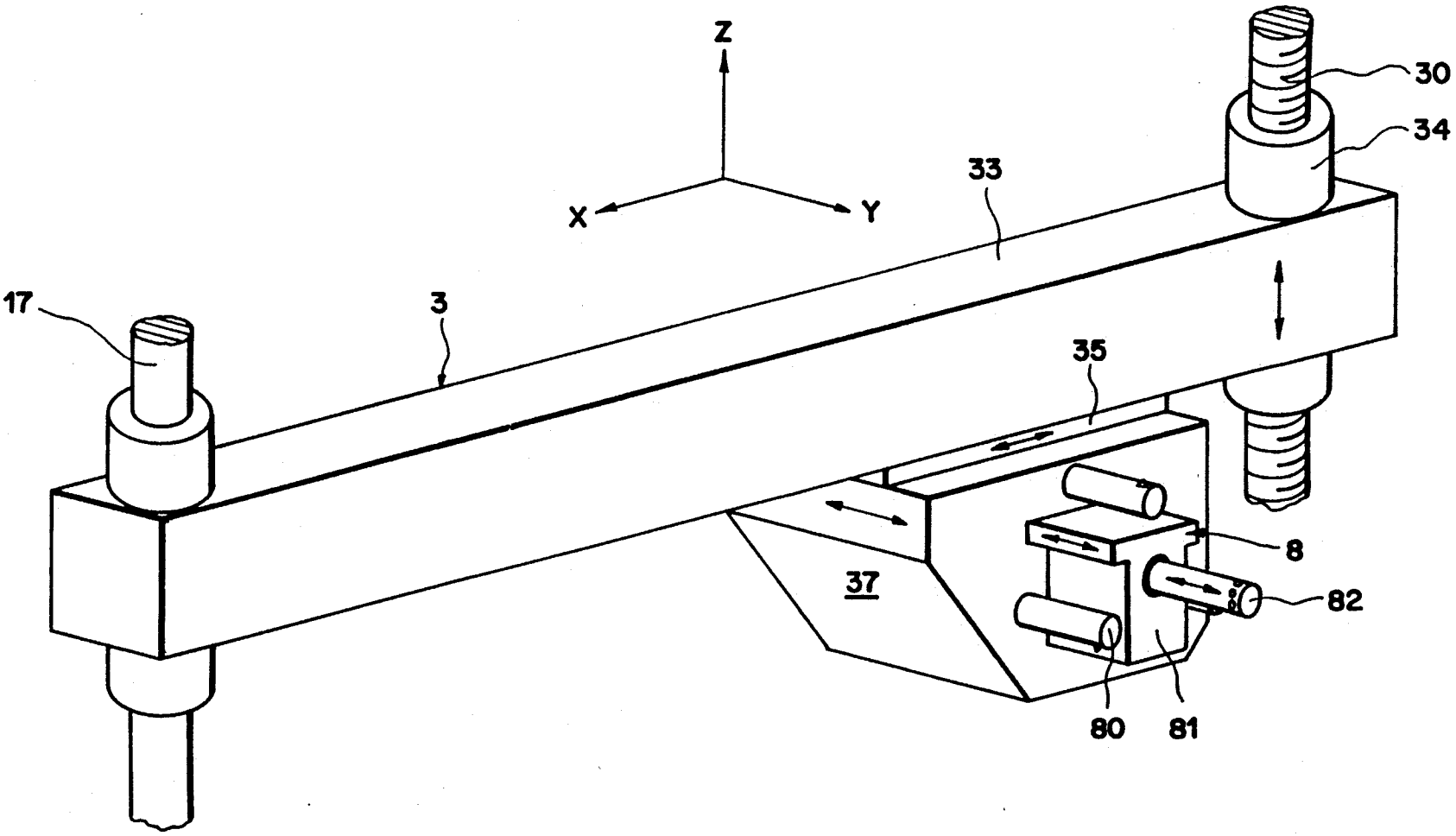
Figure 4A:
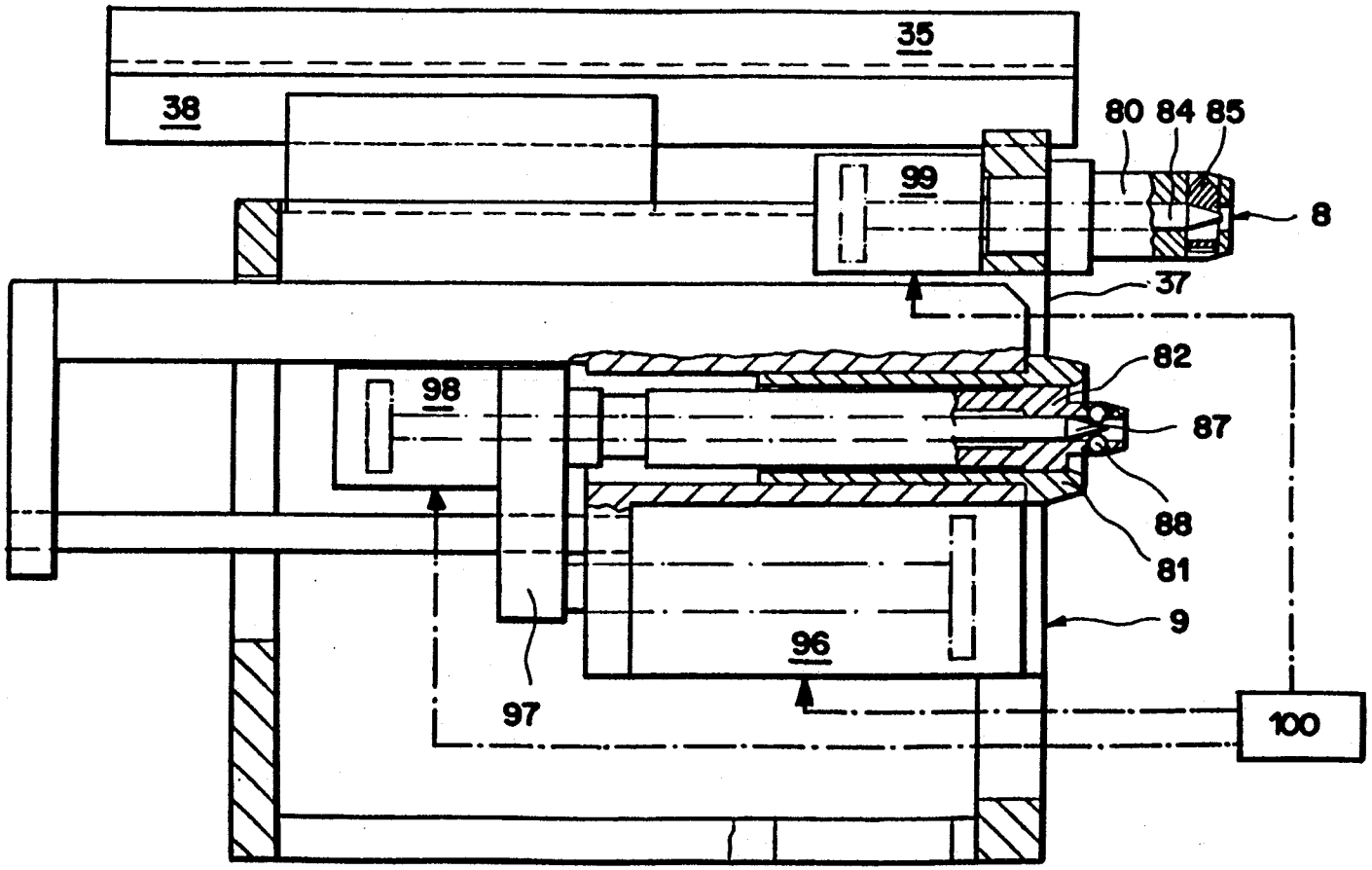
Figure 4B:
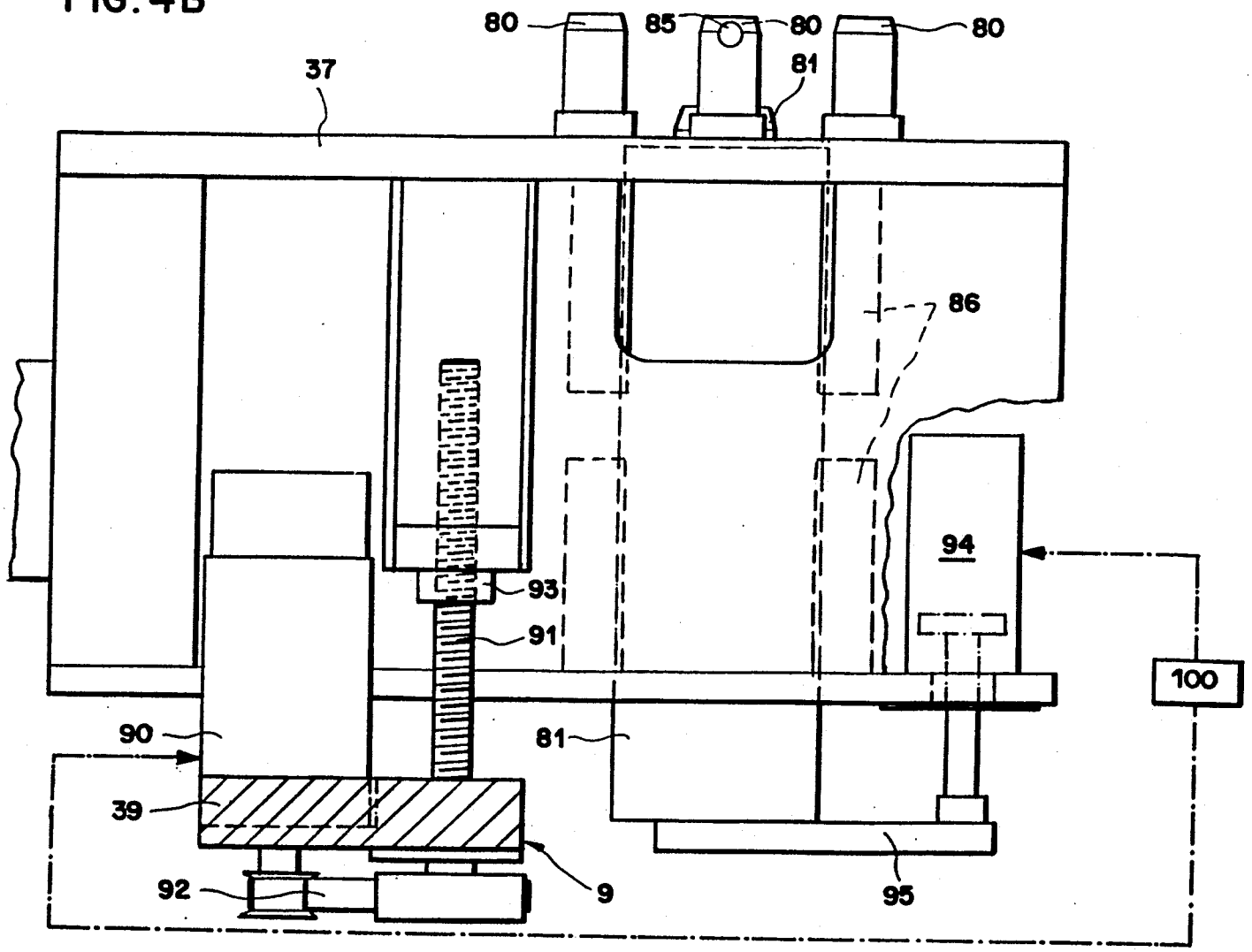
Figure 4C:
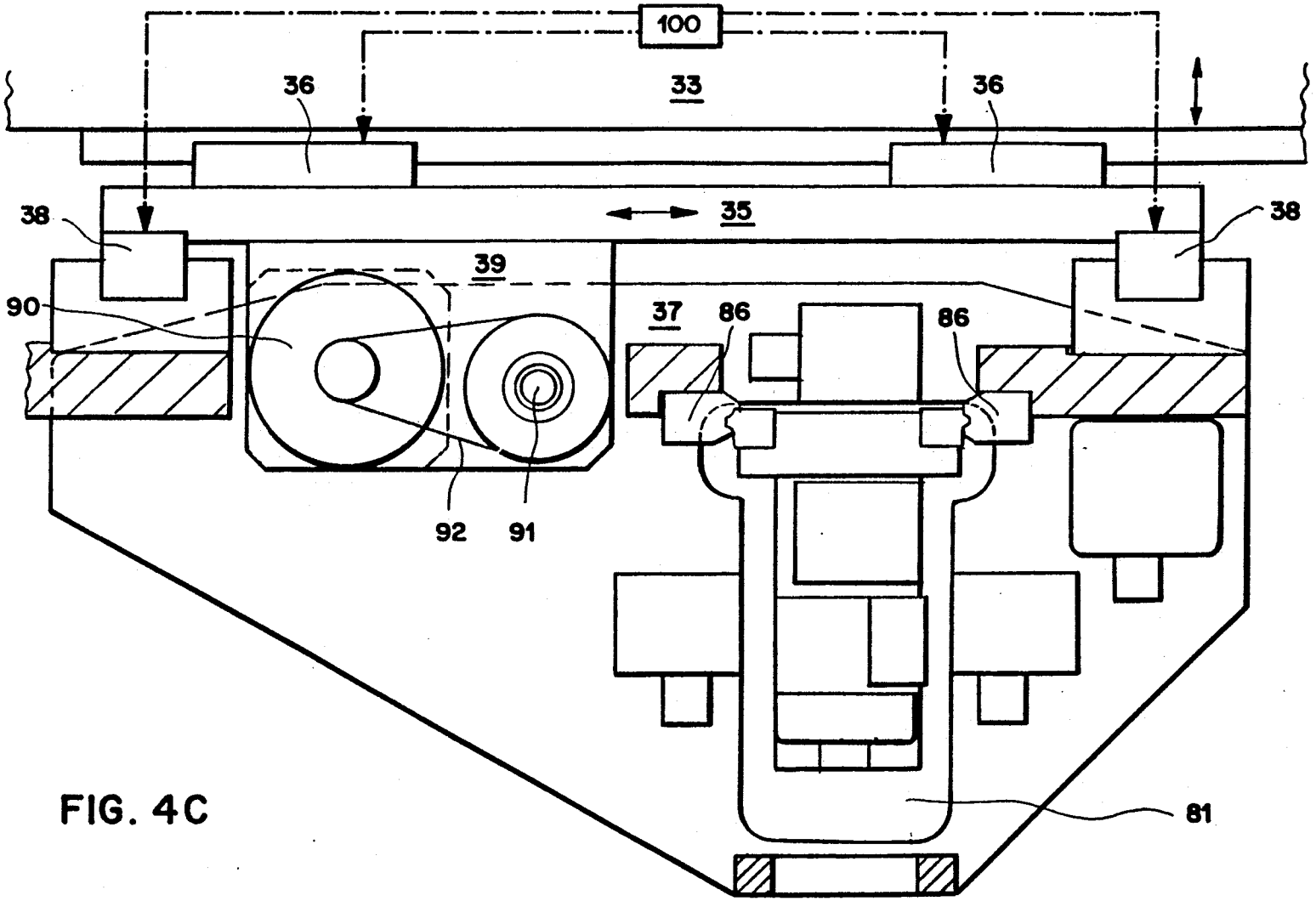
Figure 5A:
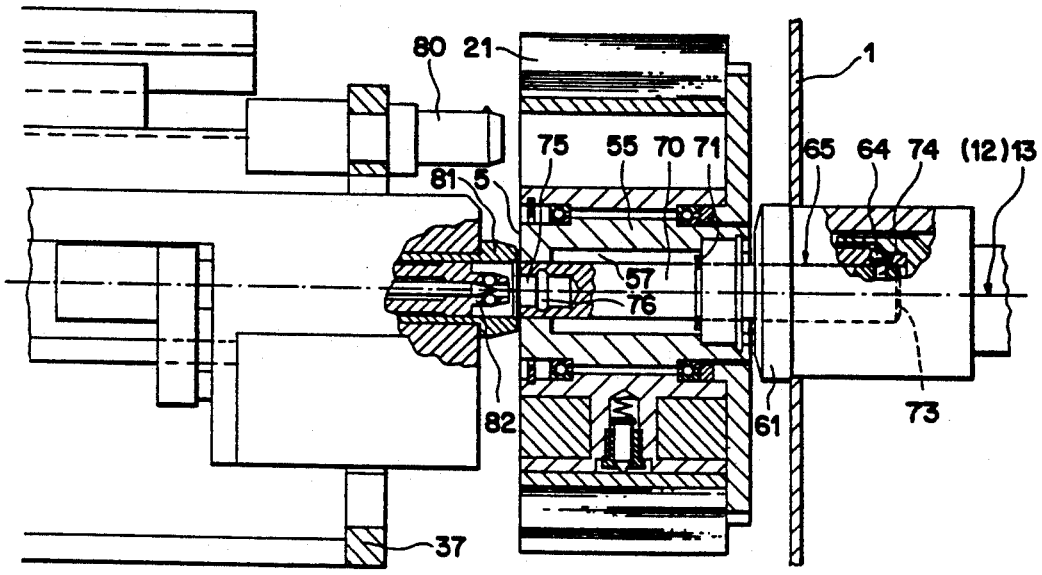
Figure 5B:
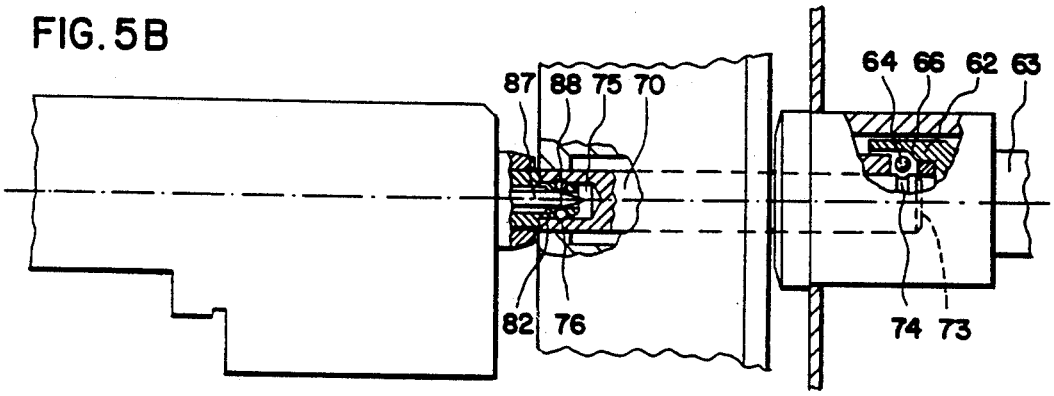
Figure 5C:
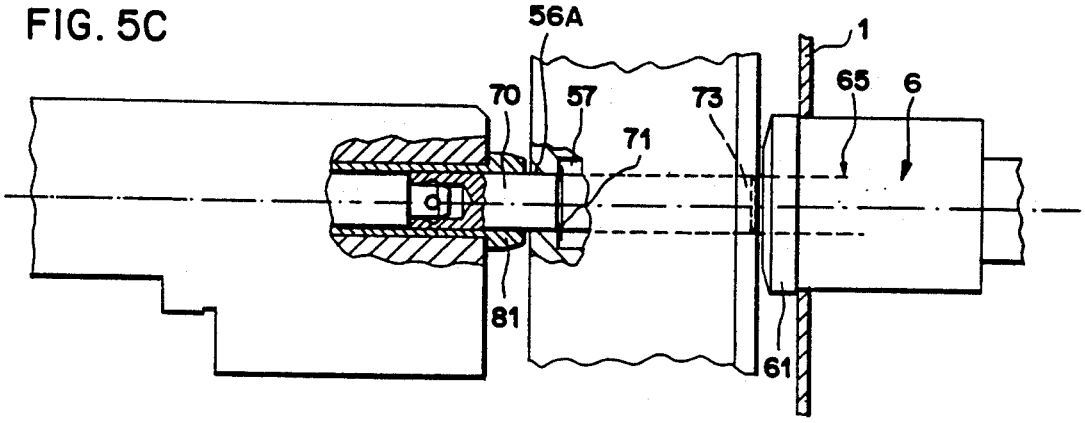
Figure 6C:
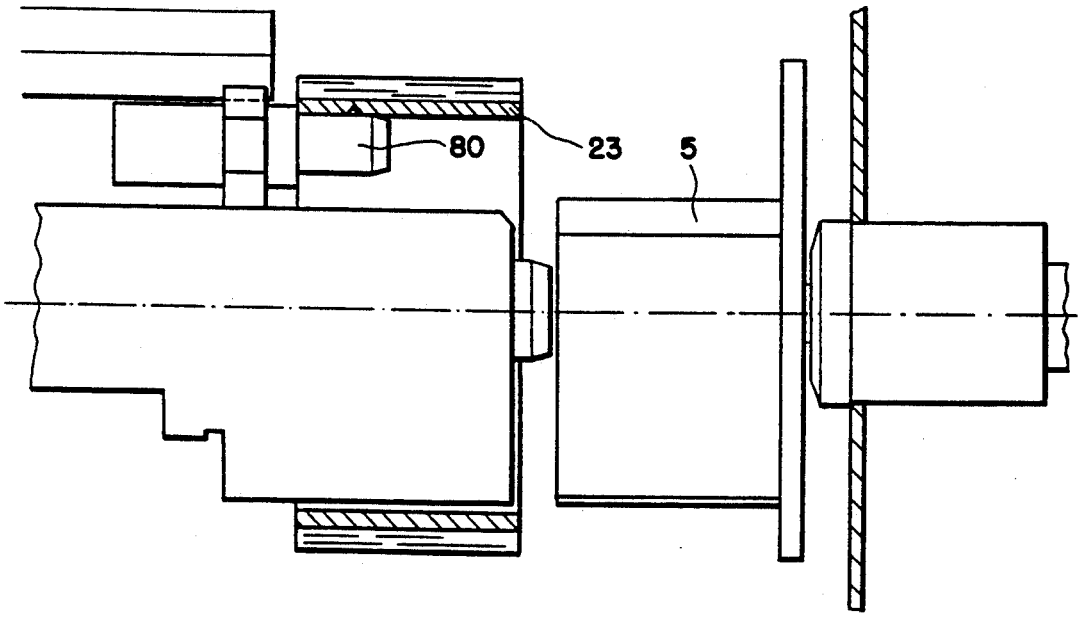

A preferred embodiment of the invention will now be described in detail with reference to the accompanying drawings, in which:

FIG. 1 is a perspective view of part of a machine for feeding cigarette paper and part of the transfer apparatus according to the present invention, FIGS. 2A and 2B are an elevation and a section taken on the line II—II of FIG. 2A, respectively, of a reel hub according to this invention, FIG. 3 is a diagrammatic perspective view of another part of the transfer apparatus, FIGS. 4A–4C are a side elevation, a top plan view, and a rear elevation, respectively, each partially in section, of part of the transfer apparatus, FIGS. 5A–5C are elevations, partially in section, illustrating different operating steps of the transfer apparatus and reel hub, and FIGS. 6A–6C are analogous views illustrating other operating steps of the transfer apparatus.

FIG. 1 shows the front part of a machine 1 for feeding cigarette paper, comprising a portion 10 for paying out reels of paper disposed in the lower part of machine 1, as well as an upper portion 11 intended for storing full reels and for eliminating the cores of empty reels. Of the set of reels 2 to be seen on machine 1, there is a reel of paper 20 in the process of being paid out about an axis 12 of machine 1, the strip of paper being pulled along farther in the direction indicated by an arrow to another part of the machine (not shown). When the first reel 20 rotating about axis 12 is virtually empty, the leading end of a strip of paper on a second reel 21, disposed about an axis 13 of machine 1, will be joined to the trailing end of the strip of paper on the first reel 20 by apparatus as described in the aforementioned co-pending application U.S. Ser. No. 743,121, not shown here in order not to clutter the drawing. When the strips of paper have been joined and reel 21 is feeding the machine, it will be necessary to withdraw the remainder of reel 20 and to dispose of it, then to transfer reel 21, being paid out about axis 13, so as to cause it to be paid out about axis 12, and finally to shift to axis 13 a new reel 22 coming from a storage axis 14 in upper portion 11 of machine 1. FIG. 1 also shows a part 15 responsible for eliminating reel cores 23 and a buffer position axis 16, the use of which will be explained below.

Added to machine 1 is a transfer apparatus 3 according to the present invention, only a portion thereof being visible in FIG. 1.

The various transfers of reels of paper 2 from one axis position to another, as well as the loading of the reels from the stored supply and the elimination of the reel cores, take place, for example, with the aid of the inventive transfer apparatus 3 of which FIG. 1 shows a worm 30, the length of which substantially corresponds to the height of machine 1, or at least to the height necessary for the various transfers, pivoting between two bearings 31A and 31B, actuated by an electric motor 32 and motion transmission means known per se, in order to raise or lower a horizontal beam 33 via a nut 34. Apparatus 3 is fixed to a frame integral with machine 1. The rest of the apparatus fixed to horizontal beam 33 is shown in more detail in FIG. 3.

A reel-braking device 4 forms part of the inventive transfer apparatus; it may be made up, for example, of a rotating gearwheel 40, braked by some electromechanical means and mounted on a lever 41 which can pivot about an axis 42 parallel to the axis of rotation of gearwheel 40, as well as of a second gearwheel 43, likewise braked by some electromechanical means. The operation of this device will be explained below.

FIG. 2A is an elevation of a reel hub 5 according to the present invention. Reel of paper 2, only the lower part of which is shown in the drawing, is made up of a strip of paper wound in a single turn about a core 23 consisting of a hollow cylindrical element made of heavy cardboard or plastic, the height of which corresponds to the width of the strip of paper. Hub 5 is intended to allow the reel to rotate about its central axis; for that purpose, it is made up of a first part 50, preferably in the shape of a triangle with very rounded corners, which is inserted within core 23 and holds this core with the aid of three tips 51 mounted on springs 52 and disposed in bores formed on each of the roundings of triangular part 50. Tips 51 penetrate slightly into the cylindrical inside surface of core 23. Thus, the three tips 51 can retract when hub 5 is inserted into core 23 and then firmly hold core 23 on hub 5. Also shown in the upper part of FIG. 2A is a portion of a gearwheel 53 serving to brake the reel, as will be explained below.

FIG. 2B is a section taken on the line II—II of FIG. 2A. Machine 1 includes bores, centered on axes 12, 13, and 16, in which hub supports 6 are mounted, intended to support a reel of paper 2 on its hub 5. Since the various hub supports are identical for each of the axes 12, 13, and 16, a single hub support 6 is described here. This support preferably comprises first of all a hollow cylindrical jacket 60 secured in a conventional manner to the bore in the frame of machine 1. A collared socket 61 is screwed into the inside front portion of cylindrical jacket 60, the collar of socket 61 projecting over the outside face of machine 1. Hub support 6 further comprises a bell-shaped inner part 62 moved between two axial positions by a jack 63 disposed at the rear of hub support 6, or by any other suitable means, as well as a plurality of bearing balls 64 held in a ball cage (not shown) and disposed along a circumference between the rear face of socket 61 and a frustoconical surface 66 inside bell 62. The use and operation of this device will be explained below.

As stated above, hub 5 is composed of a triangular part 50 supporting core 23 of reel 2 by means of three tips 51 mounted on springs 52 and disposed in radial bores in the rounded part of the corners of triangular part 50. Triangular part 50 is mounted on two ball bearings 54 disposed on the outside of a central socket 55. A shaft part 7 movable transversely, consisting of a rod 70, can slide axially within two bored cylindrical bearing surfaces 56A, 56B disposed at the ends of central socket 55 between two end positions defined by the scope allowed by a circlip 71 disposed on an outside circumference of rod 70 in a cylindrical cavity 57 contrived in the cylindrical inside surface of central socket 55 between bearing surfaces 56A and 56B. The end stop positions of circlip 71 within cavity 57 are such that in one position, as shown in FIG. 2B, front face 72 of rod 70 is flush with front face 58 of central socket 55, while the other end 73 of rod 70 is completely within an axial bore 65 in collared socket 61. A circular groove 74 is made along a periphery close to rear portion 73 of rod 70, its axial position being determined by the axial position of bearing balls 64 disposed under bell-shaped part 62.

When rod 70 is completely fitted in bore 65, in order to hold hub 5 about an axis of machine 1, jack 63 pushes bell 62 against collared socket 61 to press balls 64, via frustoconical surface 66 disposed under the bell, into circular groove 74 of rod 70. Releasing jack 63, on the contrary, allows the bearing balls to escape from groove 74 in order to free rod 70.

In the other end position of rod 70 within central socket 55, front face 72 of rod 70 projects beyond front face 58 of hub 5 by a distance corresponding to the possible axial displacement of rod 70, i.e., the possible displacement of circlip 71 within cylindrical cavity 57 between bearing surfaces 56A and 56B.

A blind bore 75 is disposed on front face 72 of rod 70, coaxially with the rod, and likewise includes a groove 76 for a ball-bearing holding device.

FIG. 2B thus shows a reel 2 fixed on a hub 5, the central socket 55 of which is secured to machine 1 along an axis 12, 13, or 16 by means of a rod 70 fixed in a hub support 6, rotation of reel 2 being permitted by ball bearings 54 disposed between central socket 55 and triangular part 50.

Part of inventive transfer apparatus 3 is illustrated diagrammatically in perspective in FIG. 3. As viewed here, the face of the apparatus shown is that facing machine 1. In a preferred embodiment, apparatus 3 first comprises worm 30, rotated between bearings 31A and 31B by means of motor 32, as shown in FIG. 1. Horizontal beam 33 has at one end a nut device 34 through which worm 30 passes. The other end of beam 33 slides on a rail or a vertical slide 17, known per se, integral with the frame of machine 1, in order to keep beam 33 from rotating about worm 30 and to guide it so that it remains absolutely horizontal. Instead of guide device 17, there may be a second worm moved in the same way as worm 30 and fitted in a second nut device disposed at the opposite end of beam 33 from nut device 34. The rotation of worm 30, in one direction or the other, therefore brings about a movement of horizontal beam 33 up or down, via nut device 34.

Therefore, by means of beam 33, supporting the rest of the transfer apparatus as will be seen below, the transfer apparatus can move along the Z axis, in a positive or negative direction, and can assume any position along that axis. Directly beneath beam 33, an intermediate part 35 is connected to beam 33 via a conventional motorized slide 35 (shown in FIG. 4C), allowing part 35 to move relative to beam 33 along the X axis, in one direction or the other, and to assume any position along that axis. A movable support 37 is placed directly beneath intermediate part 35, connected to this part by a motorized slide 38 to be described below (shown in FIGS. 4A and 4C), allowing movable support 37 to move relative to intermediate part 35 along the Y axis, on one direction or the other, and to assume any position along that axis. Thus, any point of movable support 37 can assume any position in space within the limits of the possible latitude of worm 30 and slides 36 and 38.

A seizing device 8 disposed on movable support 37 comprises first of all three seizing fingers 80, preferably disposed in a triangle and secured to support 37; the operation of fingers 80 will be described below. Device 8 further comprises a retractable socket 81 which is movable relative to support 37 along the Y axis when acted upon by, e.g., a double-acting pneumatic or hydraulic jack 94 (see FIG. 4B) and can assume two end positions on that axis, viz., a retracted position and an advanced position.

Within retractable socket 81 is a seizing rod 82 which is movable coaxially relative thereto along the Y axis when acted upon by, e.g., a double-acting pneumatic or hydraulic jack 96 (see FIG. 4A) and can assume two end positions on that axis, viz., a retracted position and an advanced position.

A preferred design of an actuating device 9 of movable support 37, retractable socket 81, and seizing rod 82 is shown in FIGS. 4A–4C, which are a side elevation, a top plan view, and a rear elevation, respectively, all partially in section.

Actuation of support 37 in direction Y relative to intermediate part 35 is clearly seen in FIGS. 4B and 4C. It takes place, for example, via an electric motor 90, preferably a stepping motor, the frame of which is secured to part 35 by means of a fixing piece 39. A shaft 91, the rear portion of which is threaded, rotating about an axis parallel to the axis of rotation of motor 90, i.e., parallel to the Y axis, is driven rotatingly by motor 90 via a pulley-and-belt transmission 92. Shaft 91 is also fixed in a bore in fixing piece 39. The threaded rearward end of shaft 91 is fitted in a nut 93 which is secured in a conventional manner to movable support 37. As indicated above, support 37 is borne under intermediate part 35 by slides 38. Thus, rotation of the rotor of motor 90 causes rotation of shaft 91, which is screwed or unscrewed in nut 93, thereby causing support 37 to move relative to part 35 in one direction or the other along the Y axis.

The means by which retractable socket 81 is moved along the Y axis relative to movable support 37 is clearly seen in FIG. 4B. For example, double-acting hydraulic or pneumatic jack 94 has its body secured to support 37, while its piston is integral with a rod fixed to a rear plate 95 fastened to the rear portion of socket 81. Slides 86 allow socket 81 to move along the Y axis relative to support 37 when acted upon by jack 94.

FIG. 4A shows the means by which seizing rod 82 moves along the Y axis relative to retractable socket 81. For example, double-acting hydraulic or pneumatic jack 96 has its body secured to socket 81, while its piston is integral with a rod fixed to another rear plate 97 fastened to the rear portion of seizing rod 82.

A double-acting hydraulic or pneumatic jack 98 has its outside body secured to rear plate 97, while its piston actuates a rod ending in a tip 87 which slides in a longitudinal bore within seizing rod 82. Bearing balls 88, held in radial bores near the end of rod 82, can be pushed toward the outside or returned toward the inside when acted upon by rod tip 87, hence by jack 98, in order to co-operate in a manner to be described below with groove 76 within bore 75 of rod 70 of transversely movable shaft part 7 mentioned earlier.

Also shown in FIG. 4A is another double-acting hydraulic or pneumatic jack 99, the body of which is fixed to movable support 37 and situated behind seizing finger 80. The piston of jack 99 actuates another pointed rod 84, the tip of which is inserted in a slot in a pin 85 which can move in a radial bore situated near the end of seizing finger 80. The shape of this slot is such that when acted upon by the tip of rod 84, i.e., by jack 99, pin 85 can project radially outside the bore of finger 80 or, on the contrary, be retracted inside, in order to grip a reel core 23, as explained below. In FIG. 4A, pin 85 is shown in retracted position. Each of the three seizing fingers 80 is provided with the same device.

Now that the various components and the operation of the elements making up the transfer apparatus have been described, reference may be made to FIGS. 5A–5C, showing several steps in the method of seizing a reel of paper being paid out in order to transfer it from axis 13 to axis 12, for instance.

In FIG. 5A, as in FIG. 2B, end 73 of rod 70 is fitted in bore 65 of collared socket 61 secured to the frame of machine 1 as described earlier. Bearing balls 64 are fitted in groove 74 of rod 70 in order to hold this rod firmly within bore 65. Reel 21 is therefore unwinding about axis 13 of machine 1.

The transfer apparatus has been placed facing reel hub 5; in particular, seizing rod 82 has been placed facing bore 75 in rod 70 by means of the Z-X movements described above. Retractable socket 81 has been advanced relative to movable support 37 so that its front face is flush with the free face of central socket 55. As may be seen in the drawing, by the position in the rear of movable support 37, seizing fingers 80 (only one of which appears in the drawing) remain set back relative to retractable socket 81.

FIG. 5B shows that seizing rod 82 has entered bore 75 of rod 70, then that tip 87 has been pushed so as to force balls 88 into groove 76 in order to integrate rod 70 with seizing rod 82. Next, jack 63 has been actuated to withdraw bell-shaped part 62 in order to release balls 64 from groove 74 so that the rear portion 73 of rod 70 is released.

It is then possible to pull seizing rod 82 toward the rear by means of jack 96, as explained above, and to insert rod 70 in the bore in retractable socket 81, as shown in FIG. 5C, for a distance such that rear portion 73 of rod 70, which was fitted in bore 65 of collared socket 61, exits completely from bore 65, so that hub 5 is totally disengaged from hub support 6, hence from machine 1. As explained previously, the distance of axial displacement of rod 70 corresponds to the distance which can be traveled by circlip 71 within cylindrical cavity 57 before striking against reamed bearing surface 56A. As shown in the drawing, the reel, having continued to wind off during the operations just described, is now held integral with the transfer apparatus, while still continuing to unwind.

By acting upon worm 30 to move horizontal beam 33 in direction Z, and on intermediate part 35 to move it in direction X, without actuating any of the Y movements, it is possible to transfer the reel rotating in the plane X-Z without any risk of tearing or twisting the strip of paper being paid out.

After having reached the new position where the reel is to unwind, e.g., axis 12, the arrangement is again similar to that of FIG. 5C, with seizing rod 82 then being advanced to cause rearward end 73 of rod 70 to enter bore 65 of hub support 6, as in FIG. 5B. Jack 63 is actuated so that bearing balls 64 are pressed into groove 74 by frustoconical surface 66 of bell 62 in order to hold rod 70 in bore 65, while pointed rod 87 is withdrawn by jack 98 so as to release balls 88 from groove 76 in bore 75 of rod 70. It then suffices to act upon jack 94 to withdraw retractable socket 81 in order to separate hub 5 completely from the transfer apparatus, as shown in FIG. 5A.

During this whole transfer operation, reel 20 has been able to continue unwinding, its axis of rotation passing from axis 13 of the machine to axis 12 without any torsional stress being exerted on the strip of paper.

Another function which can be performed by the inventive transfer apparatus is to load a full reel on a hub 5 and unload the remainder of a reel from that hub. For this purpose, referring to FIG. 2A it will be found that the triangular part 50 of hub 5 comprises on one of its arms a bore containing a part 59 which fills up the bore and has a slightly higher specific gravity than the material of which the triangular part is made. A minor unbalance is thereby created, slight enough not to hinder rotation of hub 5, but great enough so that, upon stopping, the corner of the triangle containing unbalancing piece 59 automatically moves to the bottom after a relatively short time, on the order of a few seconds, after the hub stops rotating. Hence the empty spaces between the plane faces of triangular part 50 and the inside of core 23 of reel 2 always face the three seizing fingers 80 integral with movable support 37.

The various phases of extracting a reel core or putting in a full reel may be seen in FIGS. 6A–6C.

In FIG. 6A, there is a remnant of reel 20 on its core 23 disposed on hub 5 centered on an axis of machine 1, e.g., buffer axis 16. Reel 20 is not rotating, and hub 5 has assumed its balance position, as described above, As before, the transfer apparatus is positioned facing hub 5, seizing fingers 80 being set back from the front face of the reel. Pins 85 are in retracted position.

Movable hub support 37 is then advanced by means of motor 90 and threaded shaft 91, as described above, so as to bring it to the position shown in FIG. 6B, where seizing fingers 80 fit into the empty spaces between the plane faces of triangular part 50 and the inside of core 23 of reel 20. By actuating pointed rods 84 via jacks 99, these rods push pins 85 outward so that they dig into core 23 of reel 20. As the force holding core 23 on pins 85 is greater than that exerted by springs 52 acting upon tips 51, core 23 can be extracted from hub 5 by withdrawing seizing fingers 80, i.e., movable support 37, as shown in FIG. 6C, and the entire apparatus can be moved to core elimination part 15 where core 23 is released. In exactly the same way, but in reverse, it is possible to go and pick up a fresh reel 22 at storage axis 14 and place it on an empty hub 5.

The complete operation of the transfer apparatus can now be explained in relation to the operation of a machine for joining two ends of a strip of paper, particularly a machine such as that described in the aforementioned co-pending application Ser. No. 07/743,121, now U.S. Pat. No. 5,169,082.

Taken as a point of departure, making reference to FIG. 1 for locating the positions of the axes, is a reel 21 being paid out from axis 13 of machine 1, axis 12 being free and a second empty hub 5 being held in waiting at buffer axis 16. At least one full reel 22 is stored at axis 14. In order to brake the rotation of reel 21 and give the strip of paper a constant tension, braking gearwheel 40 meshes with gearwheel 53 integral with hub 5 supporting reel 21. In this position (not shown), lever 41 is in its upper position. When a certain amount of reel 21 has been paid out, it must be moved from axis 13 to axis 12 in order to proceed with joining the ends of the strips as explained in the aforementioned co-pending application.

For that purpose, the procedure as illustrated in FIG. 5A–5C is employed, viz., transfer apparatus 3 is placed opposite hub 5 on axis 13, seizing rod 82 is inserted in bore 75 of rod 70, these two elements are blocked by bearing balls 88, the rearward end 76 of rod 70 held by balls 64 is released, and seizing rod 82 is withdrawn, pulling rod 70 along and disengaging it from hub support 6, hence from axis 13. By moving the slides in the X-Z plane as described earlier, transfer apparatus 3 is positioned opposite axis 12, where hub 5 is secured in the manner described.

During this transfer movement, lever 41 of the braking device has accompanied this movement by pivoting about its axis 42 in such a way that braking wheel 40 remains engaged with gearwheel 53 integral with hub 5 so that the tension exerted on the strip of paper remains constant. When hub 5 is in place on axis 12, second braking wheel 43 engages gearwheel 53 in order to bring about the braking effect, while lever 41 goes back up into its starting position. Rotating reel 21 has thus been transferred from axis 13 to axis 12 without subjecting the strip of paper to any lateral torsional stress since the plane of rotation of the reel has not varied, and the strip remains braked so as to undergo constant traction.

The following step consists in picking up a full reel 22 from the supply stored along axis 14 and placing it on the empty hub 5 held in waiting on buffer axis 16. For that purpose, the transfer apparatus is moved to axis 14, the three seizing fingers 80 are inserted within core 23 of the first reel, pins 85 are actuated to seize the core, then by withdrawing movable support 37 backward this reel is extracted from the supply. The transfer apparatus then moves to buffer axis 16 where an empty hub 5 is installed. Since the hub is stationary, the faces of triangular part 50 are so disposed as to be able to receive seizing fingers 80 supporting core 23 of reel 22. Seizing fingers 80 are therefore advanced by advancing movable support 37 in such a way that the rear of the reel butts against gearwheel 53. Pins 85 holding core 23 on seizing fingers 80 are then retracted, which causes core 23 to be held then by tips 51 pressed by springs 52 and thus to be integral with hub 5.

It is now a matter of transferring the reel mounted on a hub from the buffer position 16 to axis 13 which was previously freed. For that purpose, although hub 5 is stationary, it is seized by seizing rod 82, disengaged from axis 16, then transferred and fixed to axis 13 as previously.

After this, a series of operations commences, consisting in opening reel 21 disposed on axis 13, eliminating the outside turns, setting the reel in rotation, placing the end of the strip of paper opposite the strip of paper unwinding from reel 20 situated on axis 12, cutting this strip of paper, and joining the two free ends so that it is now the upper reel, disposed on axis 13, which is feeding the machine. These various operations will not be described in further detail here as they do not form part of the present invention. A detailed description thereof is to be found in the mentioned application U.S. Ser. No. 743,121, now U.S. Pat. No. 5,169,082.

Reel 20, which is almost empty, on its core 23, is now at a standstill on axis 12. The transfer apparatus moves to face axis 12, seizing rod 82 seizes rod 70 and disengages it from hub support 6 disposed on axis 12, and the entire transfer apparatus withdraws in order to be able to pass above reel 21 being paid out on axis 13, then takes up a position facing buffer axis 16 in order to fix hub 5 there as described. The remnant of the reel together with core 23 is extracted from hub 5 by seizing fingers 80 and brought to axis 15, which comprises an endless-belt device for conveying empty cores 23 and is responsible for eliminating the empty cores from the machine.

This operation having been carried out, the cycle is completed, and the various steps described above can be recommenced.

Another possible operation of the transfer apparatus consists in using it to load the supply of fresh reels 22 on axis 14, for owing to the crowding of the various parts of the machine, this axis can usually not be directly accessible. This operation can take place only when the machine is at a standstill. For this purpose, a hub 5 is disposed on any one of the accessible axes, preferably buffer axis 16, a reel is placed on this hub by hand, then the transfer apparatus is controlled in order to come and seize solely the reel and its core by means of seizing fingers 80 and to take it opposite storage axis 14 in order to deposit it there.

The apparatus for transferring unwinding reels as described above is a preferred embodiment of the invention. It will be obvious that diverse modifications may be envisaged, particularly as concerns the mechanical devices described. For example, one or more of the movement controls by jack may be replaced by movement controls by electromagnet or by any other suitable device. By the same token, the movements along the X, Y, and Z axes may be performed by elements other than those described here. The same applies to the transfer method, which may differ according to the makeup of the transfer apparatus.

Various additional devices not shown in the drawings may supplement the inventive transfer apparatus. In particular, the different operating stages of the apparatus may be automated by means of an electronic control 100, which can be linked, for example, to reels 20, 21, motors 32 and 90, slides 36, 38, braking wheel 43, and jacks 63, 94, 96, 98 and 99 (as shown in FIGS. 1, 2B, 4A, 4B and 4C). In addition, sensors can be used to check the amount of paper remaining on the reels being paid out; other limit sensors can control the whole of the movements described so that the electronic control always knows the exact position of the various elements making up the transfer apparatus; and a reel-advancing device can be provided on the storage supply so that the reel to be seized is always in the same plane.

What is claimed is:

1. Transfer apparatus for transferring a bobbin or reel being paid out, between a first pay-out shaft and a second pay-out shaft of a machine, the reel remaining in a constant plane of rotation during the transfer, by seizing a hub of the rotating reel, detaching the hub from the first pay-out shaft, transferring the hub together with the rotating reel to the second pay-out shaft, and fixing the hub to the second pay-out shaft, said transfer apparatus comprising:

first means of displacement in a first direction, including at least one worm, a nut device, and a horizontal beam subjected to a translatory motion via said at least one worm and said nut device, second means of displacement in a second direction perpendicular to said first direction, including a first motorized slide and an intermediate support fixed to said horizontal beam via said first motorized slide, third means of displacement in a third direction perpendicular to said first and second directions, including a second motorized slide and a movable support fixed to said intermediate support via said second motorized slide, a retractable socket disposed on said movable support and adapted to assume two positions in a direction parallel to said third direction, relative to said movable support, a seizing rod disposed on said retractable socket and adapted to assume two positions in a direction parallel to said third direction, relative to said retractable socket, a plurality of hub-support means intended to be disposed on a plurality of respective shafts forming part of the machine, and a reel-hub device capable of supporting a rotating reel and comprising a part capable of sliding axially in said third direction.

2. The apparatus of claim 1, further comprising a braking device designed to act upon a reel being transferred.

3. The apparatus of claim 1, further comprising a plurality of seizing fingers, fixed relative to said movable support, each of said fingers including a retractable pin capable of projecting radially for seizing a reel core.

4. The apparatus of claim 1, further comprising an automatic control device.

5. The apparatus of claim 1, wherein said retractable socket comprises means for displacement in said third direction including an electromagnet or a hydraulic or pneumatic jack having a body integral with said movable support and a piston integral with said retractable socket.

6. The apparatus of claim 1, wherein said seizing rod comprises means for displacement in said third direction including an electromagnet or a hydraulic or pneumatic jack having a body integral with said retractable socket and a piston integral with said seizing rod.

7. The apparatus of claim 6, further comprising a pointed-tipped rod and actuating means including a hydraulic or pneumatic jack having a body fixed to a rear part of said seizing rod and a piston adapted to actuate said pointed-tipped rod, wherein said seizing rod includes a plurality of radial bores disposed over a circumference near the front end of said seizing rod and a plurality of bearing balls disposed in said bores, said balls being capable of projecting outside of said seizing rod when acted upon by said pointed-tipped rod moved by said actuating means.

8. The apparatus of claim 1, wherein said plurality of hub-support means are respectively disposed on said first pay-out shaft, said second pay-out shaft, a buffer shaft, a storage shaft, and a shaft for eliminating reel cores, said shafts forming part of the machine.

9. The apparatus of claim 8, wherein each of said hub-support means comprises:

a projecting collared socket intended to be fixed on the face of the machine, a hollow cylindrical jacket fixed to a rear part of said collared socket, a bell-shaped part, coaxial with and inside said cylindrical jacket and including a frustoconical inside surface portion, said bell-shaped part being moved with a movement of advance or withdrawal via actuating means including a piston of a hydraulic or pneumatic jack having a body fixed to the rear of said hollow cylindrical jacket, and a plurality of bearing balls disposed in a cage along a periphery of a longitudinal bore coaxial with the collared socket, and with the bell-shaped part, and being capable of radially assuming two positions when acted upon by said frustoconical surface portion.

10. The transfer apparatus of claim 9, wherein said reel-hub device includes a part comprising empty spaces, mounted on a central socket via ball bearings, said central socket including a bore, a rod movable longitudinally in said bore, a first end of said rod including a groove along a perimeter, intended to receive balls disposed under the frustoconical surface portion of said bell-shaped part when said first rod end is inserted in said longitudinal bore of said hub support, the other end of said rod including a coaxial blind bore including a groove along a perimeter, intended to receive the balls disposed near the end of the seizing rod when said seizing rod is inserted in said blind bore.

11. The transfer apparatus of claim 10, wherein perimeter portions of the part of said reel-hub device comprising empty spaces include a radial bore containing a pointed rod portion pushed radially toward the outside by a spring disposed at ,the bottom of said bore.

12. The transfer apparatus to claim 10, wherein said reel-hub device includes an unbalancing piece intended to stabilize said hub according to a certain angular position upon stopping.

13. The transfer apparatus of claim 12, wherein said empty spaces comprised by said part of said reel-hub device are adapted to receive said seizing fingers of said movable support.

14. The transfer apparatus of claim 13, wherein said empty spaces are spaces situated between plane faces of a substantially triangular part and the inside perimeter of a reel core.

15. The transfer apparatus of claim 2, wherein said braking device comprises a lever, one end of which pivots about a first shaft parallel to said third direction, a first gearwheel, braked in rotation, pivoting about a second shaft disposed on the other end of said lever and parallel to said first shaft, said first gearwheel continuously meshing with a second gearwheel disposed on the reel-support hub during the transfer of said hub between said first paying-out position to said second paying-out position, and of a third gearwheel, braked in rotation, pivoting about a third shaft parallel to the preceding shafts and meshing with said second gearwheel when said reel-hub device has been transferred onto said second paying-out position.

16. The transfer apparatus of claim 4, wherein said automatic control device comprises means for:

controlling a movement of said transfer apparatus along three co-ordinate axes, from a waiting position, so as to bring it opposite a reel-support hub rotating about a first shaft of the machine, controlling an advance of a seizing rod and its fixing on one end of a rod of said hub, controlling a disengagement of the other end of said rod of said hub from its hub support, controlling a withdrawal of said seizing rod while carrying along said rod of said hub, controlling a movement of said hub while disposed on said transfer apparatus in two directions, said directions being included in the plane of rotation of the reel in order to bring it opposite a second shaft of the machine, controlling an advance of the seizing rod in order to push said other end of the hub rod into a bore disposed in a hub support on said second pay-out shaft, controlling a fixing of said other rod end in said hub support, controlling a disengagement of said seizing rod from said hub rod, controlling a withdrawal of the seizing rod and a movement of the transfer apparatus to a waiting position.

17. The transfer apparatus of claim 16, wherein said automatic transfer device further comprises means for:

controlling a movement of said transfer apparatus along three co-ordinate axes, from a waiting position, so as to bring it opposite a reel-support hub disposed on a shaft of the machine, controlling an advance of the seizing fingers into empty spaces between a portion of the hub and the core of the reel, controlling a projection of pins disposed on said seizing fingers in order to seize the core of the reel, controlling a withdrawal of said seizing fingers in order to withdraw said reel core from the hub, controlling a movement of said transfer apparatus to a core-elimination shaft or a storage shaft, controlling an advance of said seizing fingers in order to deposit the reel core on said elimination shaft or on said storage shaft, controlling a retraction of said pins in order to release the reel core, controlling a withdrawal of said seizing fingers, controlling a movement of said transfer apparatus to a waiting position.

18. The transfer apparatus of claim 17, wherein said automatic control device further comprises means for:

controlling a movement of said transfer apparatus along three co-ordinate axes, from a waiting position, so as to bring it opposite a reel disposed on a storage shaft of the machine, controlling an advance of the seizing fingers under the core of the reel, controlling a projection of pins disposed on said seizing fingers in order to seize the core of the reel, controlling a withdrawal of said seizing fingers in order to withdraw said reel from the storage shaft, controlling a movement of said transfer apparatus to a reel-hub device disposed on a shaft of the machine, controlling an advance of said seizing fingers in order to deposit the reel on said hub, controlling a retraction of said pins in order to release the reel core, controlling a withdrawal of said seizing fingers, controlling a movement of said transfer apparatus to a waiting position.

19. A method of transferring a bobbin or reel being paid out, between a first pay-out shaft and a second pay-out shaft of a machine, the reel remaining in a constant plane of rotation during the transfer, wherein the improvement comprises the steps of causing a transfer apparatus moving through space to:

seize a hub of the rotating reel, detach the hub from the first pay-out shaft, transfer the hub together with the rotating reel to the second pay-out shaft, and fix the hub to the second pay-out shaft.

20. The transfer method of claim 19, wherein a part of the reel-hub device is seized by a part of the transfer apparatus and withdrawn from a support portion of the machine in a direction perpendicular to the plane of rotation of the reel.

21. The transfer method of claim 20, comprising the further step of braking the reel during the transfer thereof from the first pay-out shaft to the second pay-out shaft.

22. The transfer method of claim 19 applied to a machine for paying out a strip of cigarette paper.

* * * * *